United States Patent [19]

Sutherland

[11] 4,202,446

[45] May 13, 1980

[54] BOTTLE PACKAGE

[75] Inventor: Robert L. Sutherland, Campbell Hall, N.Y.

[73] Assignee: Federal Paper Board Company, Inc., Montvale, N.J.

[21] Appl. No.: 959,489

[22] Filed: Nov. 13, 1978

[51] Int. Cl.[2] ..... B65D 65/12; B65D 65/22

[52] U.S. Cl. ..... 206/147; 206/427; 206/434; 206/492; 206/1.5; 229/40; 229/39 R; 229/89

[58] Field of Search ..... 206/147, 140, 138, 141-144, 206/434, 435, 427, 491, 492, 1.5; 229/89, 40, 39 R

[56] References Cited

U.S. PATENT DOCUMENTS

| | | | |
|---|---|---|---|
| 1,649,452 | 11/1927 | De Clercq | 229/38 |
| 2,372,351 | 3/1945 | Arneson | 206/189 X |
| 3,176,902 | 4/1965 | Champlin | 229/40 |
| 3,181,727 | 5/1965 | Graser et al. | 229/40 X |
| 3,688,972 | 9/1972 | Mahon | 206/427 X |
| 3,904,036 | 9/1975 | Forrer | 206/427 |
| 3,994,398 | 11/1976 | Graham | 206/434 X |
| 4,022,372 | 5/1977 | Graser | 229/40 |
| 4,029,207 | 6/1977 | Gordon | 206/427 |
| 4,101,069 | 7/1978 | Wood | 229/40 |

FOREIGN PATENT DOCUMENTS

| | | | |
|---|---|---|---|
| 965054 | 3/1975 | Canada | 229/40 |

*Primary Examiner*—Joseph Man-Fu Moy

*Attorney, Agent, or Firm*—Fitzgibbon, Roehrig, Greenawalt & Gilhooly

[57] ABSTRACT

A wraparound type carrier package for a group of bottles which are arranged in a double row and in transversely aligned pairs, which package is formed by wrapping about the top, sides, ends and bottom of the bottles, a cut and scored blank of paperboard, or similar foldable sheet material, which blank is divided into wall forming panels with interengaging locking elements in the margins of the end panels and with end closure forming panels hinged to the end edges of sidewall forming panels, the latter being adapted, when the package is formed, to be held in end closing position by downturned narrow hinged panels on the end edges of the top wall forming panel which are provided with latching elements in engagement with the infolded end closure panels.

4 Claims, 6 Drawing Figures

BOTTLE PACKAGE

This invention relates to carrier cartons for packaging groups of articles, such as bottled beverages, or similar articles, and is more particularly concerned with improvements in a carton structure which is derived by wrapping a cut and scored blank of paperboard, or similar foldable sheet material, about the top, sides and bottom of a group of the articles and forming therewith an article encasing tube having hinged panels on the end edges of the sidewalls which are held in closed position by locking panels depending from the ends of the top wall panel.

In the marketing of bottled beverages, and products, of similar character many carrier cartons have been developed which are derived by folding or wrapping about a group, or assembly, of the bottled products, a cut and scored blank of paperboard, or similar foldable sheet material, and securing overlapped margins of the end panels in the blank, generally by means of an adhesive or interengaging locking elements. In packaging soft drinks and other products which are not subject to deterioration or change in character when exposed to light for a substantial length of time the tubular carton formed in this manner is normally fabricated with open ends, so as to save material. However, in packaging bottled beer, for example, which suffers a loss in quality when exposed to light for a lengthy period, it is desirable that the ends of the tubular wrapper be closed so that the end bottles have minimum exposure to light. U.S. Pat. No. 3,670,950, granted to Harry J. Rossi on June 20, 1972, discloses a wraparound type tubular package with opposite ends closed by "barn door" panels which are hinged to the sidewalls and connected to bottom wall panels by integral foldable web members. The end closure panels are held in closure forming position by the connecting webs at the bottom, and, at the top, by a narrow panel hinged to the end edge of the top wall panel which is folded down over the top margins of the closure panels. Generally this top end panel will also serve as an identification panel.

The problem which has been recognized as the most difficult of solution in designing this type package has been how to provide, with a minimum of material, a tight wrapped package having end closure panels with a satisfactory arrangement for holding the end panels in closure forming position, so as to insure that the ends of the package will remain closed during normal handling of the package.

It is a general object of the present invention to provide an improved packaging arrangement for articles having the general form of beverage bottles in which a blank of paperboard or similar foldable sheet material is cut, scored and folded into tubular configuration about the top, sides and bottom of a group of the articles arranged in side-by-side relation, with the end margins of the blank being overlapped and secured by interengaging locking elements, so as to form a tightly wrapped tube about the bottles and with cooperating end closure panels which are hinged to the sidewalls and securely held in fully closed position by a narrow hinged end panel which is folded down from the end edge of the top wall and connected in interlocked relation with portions of the end wall panels.

A more specific object of the invention is to provide a carrier carton type package for articles, particularly, bottled products wherein the carton is formed by enclosing an assembly of the bottles in a wraparound blank of paperboard, or the like, which is cut and scored to provide connected wall forming panels including top, side, bottom and end walls, and wherein the bottom wall forming panels are connected by cooperating interengaging locking and latching elements and the end wall forming panels are latched so as to insure that all the wall panels are held in fully closed, carton forming position during normal handling.

A further object of the invention is to provide in a package of the type described, an improved end closure panel arrangement which is relatively simple, which requires minimum material and minimum alteration in existing automatic machinery for fabricating this type package and which provides for positive retention of the end wall panels in end closing position.

The invention as claimed herein is embodied in a bottle enclosing package formed with a wraparound type blank of foldable sheet material which is adapted to fully enclose a group of the bottles, arranged in double row transversely paired relation, the carton when formed having integral top, side and bottom walls disposed in tube forming configuration and with end closure panels hinged to opposite ends of the sidewalls and retained in closed position at each end of the package by a narrow panel depending from the end edge of the top wall and having an interlocking connection with top marginal portions of the closure panels.

The aforesaid objects and other objects and advantages of the invention will become more apparent when reference is made to the accompanying detailed description of the preferred embodiment of the invention, which is set forth therein by way of example, and shown in the drawings, wherein like reference numerals indicate corresponding parts throughout.

Figure 1:
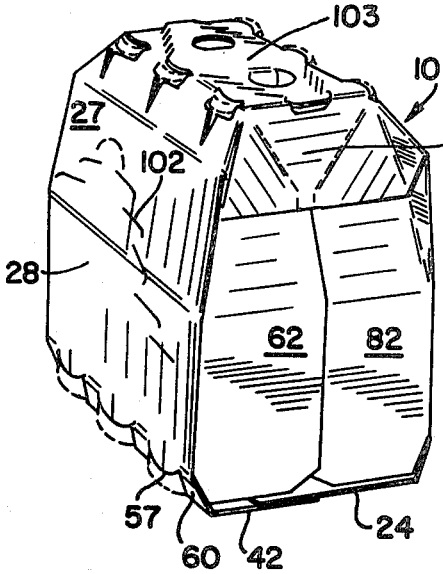
FIG. 1 is a perspective view of a bottle carrier type package which embodies the principles of the invention with portions of the bottles being indicated in phantom line.
Figure 3:
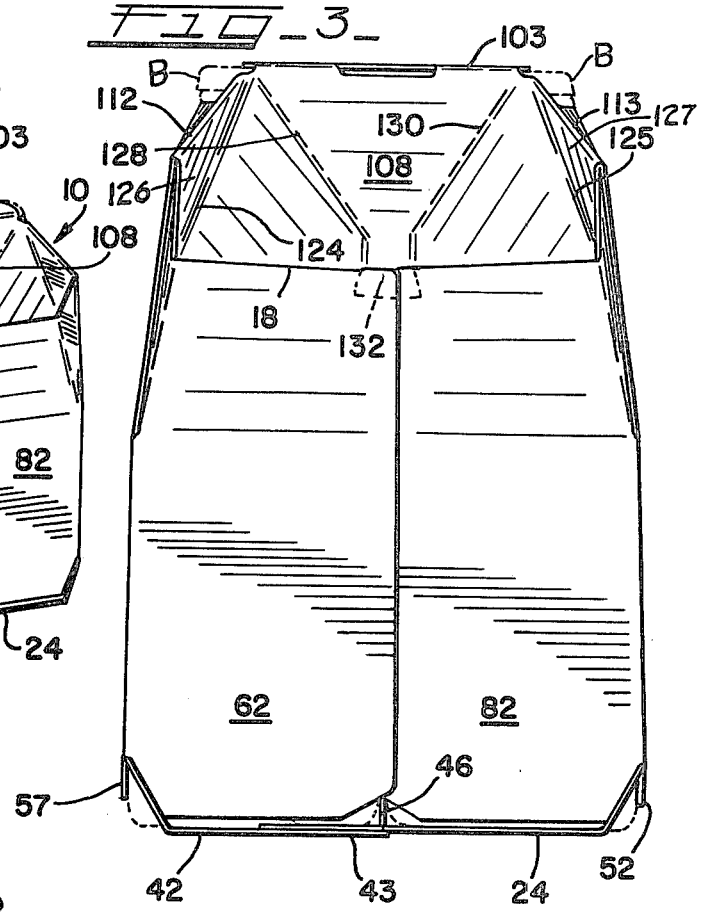
FIG. 3 is an end view of the package of FIG. 1, to a larger scale.
Figure 2:
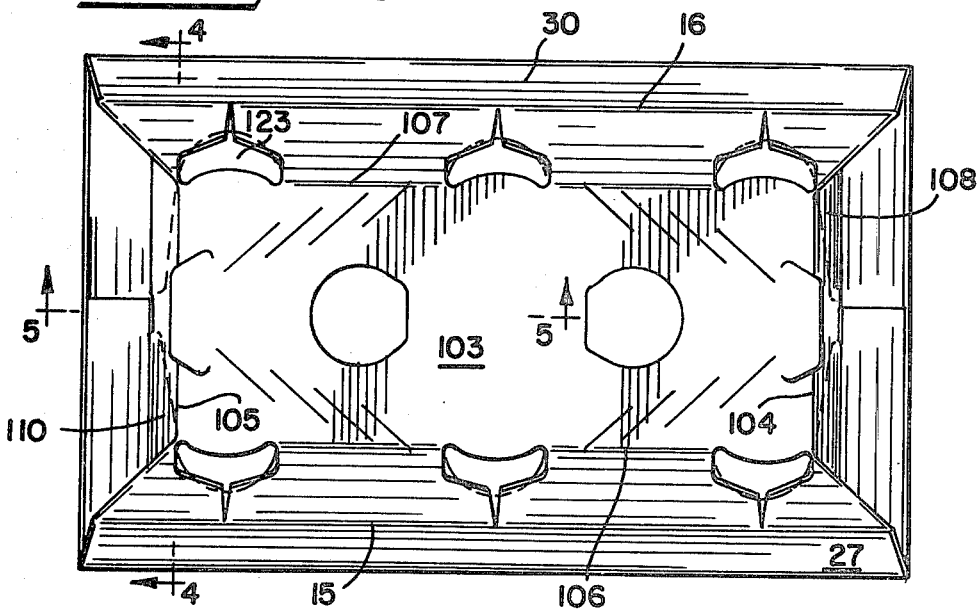
FIG. 2 is a top plan view of the package of FIG. 1, to a larger scale.
Figure 5:
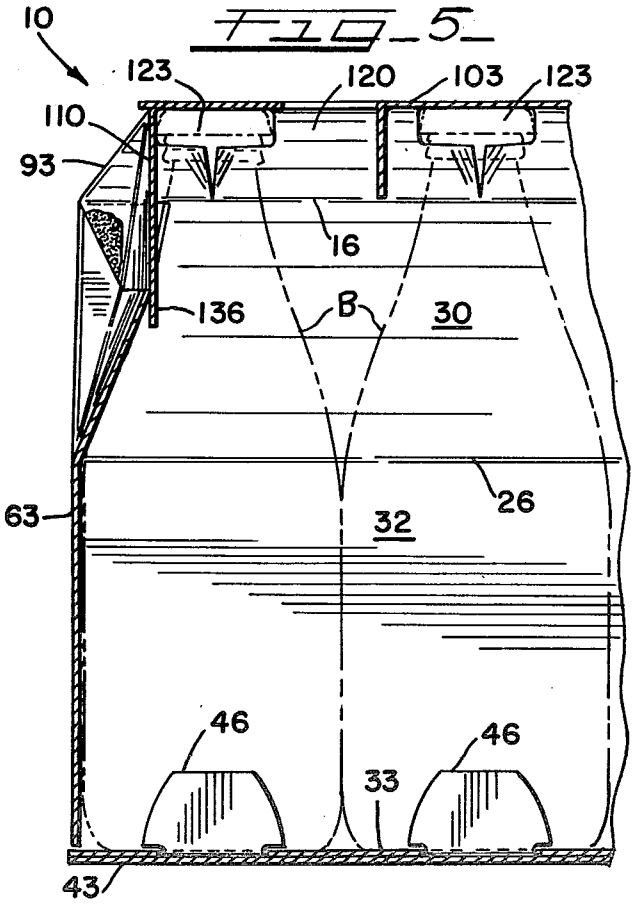
FIG. 5 is a cross sectional view taken on the line 5—5 of FIG. 2.
Figure 4:
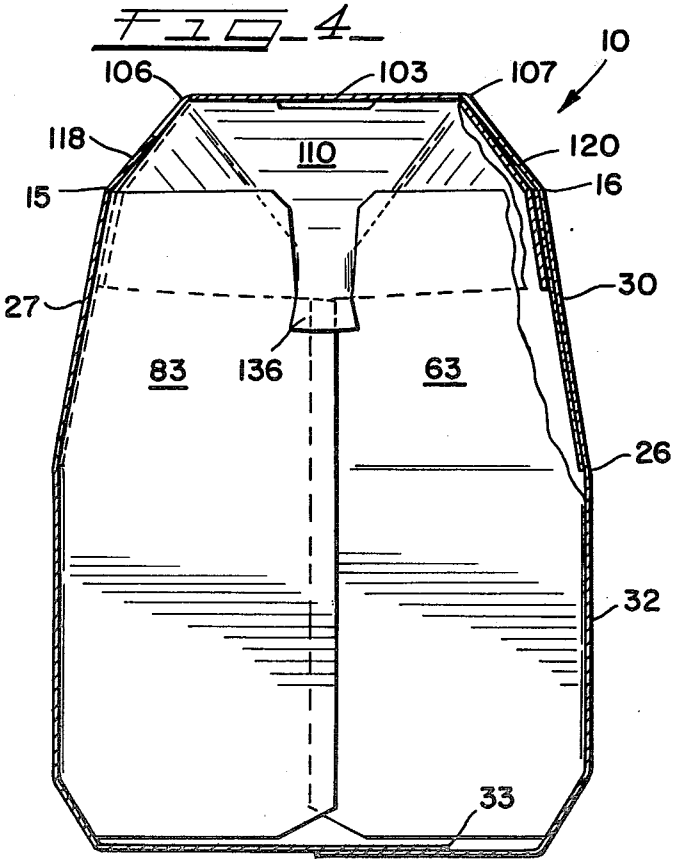
FIG. 4 is a cross sectional view taken on the line 4—4 of FIG. 2.

Referring to the drawings, there is illustrated a carrier carton type six bottle package and a cut and scored blank of paperboard, or similar foldable sheet material, for forming the package, which embodies the principal features of the invention. It will be understood that the principles of the invention may be otherwise applied and that the following description of the carrier carton, as shown in the drawings, is for the purpose of setting forth the form of the invention which is presently preferred.

Figure 6:
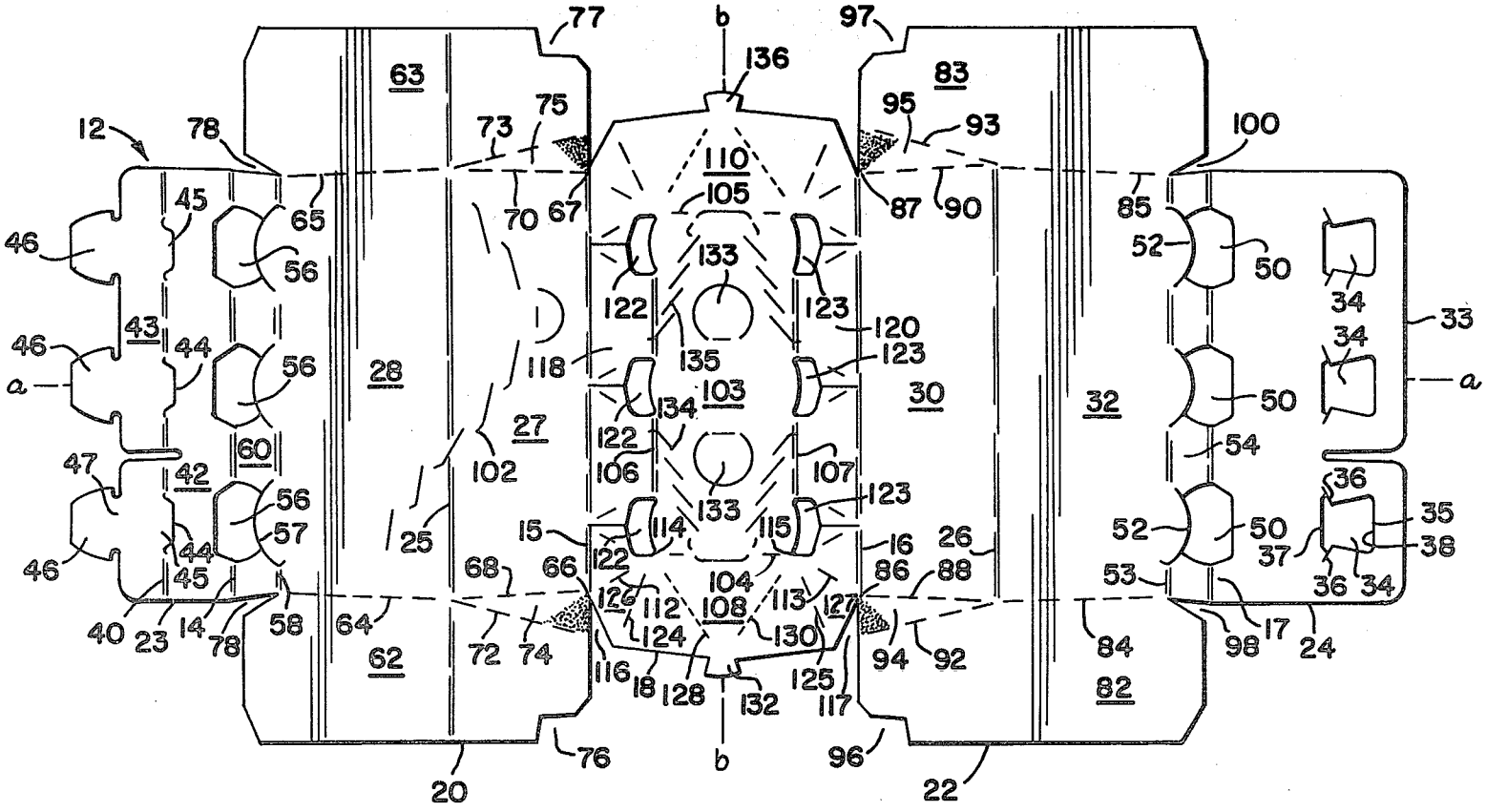
FIG. 6 is a plan view showing the outside face of a carton forming blank which is cut and scored for wrapping about an assembly of bottles to form the package illustrated in FIG. 1.

The carton structure 10 which is illustrated in FIGS. 1 to 5 is formed by wrapping the cut and scored blank 12 of FIG. 6 about an assembly of beverage bottles B which are arranged in two rows of three bottles each with the bottles in transversely paired alignment. The blank 12, which is of paperboard, or similar foldable sheet material, of suitable gauge or weight, is cut and scored as shown in FIG. 6, so as to divide it into wall forming panels and associated panel connecting means, together with bottle movement restraining means. Except for certain details hereinafter referred to, the blank 12 is symmetrical about longitudinal and transversely extending center lines which are indicated at a—a and b—b in FIG. 5. It is divided on parallel, longitudinally spaced, transversely extending hinge forming crease or score lines 14, 15, 16 and 17, into top wall forming center panel section 18, adjoining sidewall forming panel sections 20 and 22, and bottom wall forming panel sections 23 and 24, the latter being at opposite end margins of the blank 12. The sidewall forming panel sections 20, 22 are subdivided by transversely extending score lines 25 and 26, which are parallel with and spaced an equal distance from the score lines 15 and 16, into associated top and bottom sidewall forming panels 27, 28 and 30, 32, respectively. The center panel section 18 of the blank, in which a top wall and associated panels are formed, has a dimension in the direction longitudinally of the blank, that is, the distance between the transverse score lines 15 and 16, which is somewhat greater than the distance between the outside edges of the capped top of a pair of transversely aligned bottles so that portions thereof adjacent the score lines may be folded downwardly at the top of the bottles and form the top portions of the sidewall structure, with the downward inclination, or slant, of these portions being somewhat less than that of the top sidewall panels 27 and 30 which are likewise slanted when the blank is wrapped about a group of bottles. The score lines 25 and 26 are located so that the top sidewall panels 27 and 30 follow generally, or generally conform to, the upward slant of the bottle surfaces at the upper portions of the bottles, that is, the portions extending from the main portion of the bottle body to the neck portion thereof. The dimensions of the bottom sidewall panel portions 28 and 32 in the direction longitudinally of the blank, correspond generally to the height of the main body portions of the bottles B. The score lines 25, 26, of course, serve to facilitate bending of the material and provide uniformity in the sidewall configuration. The transverse dimension of the bottom wall forming end panel sections 23 and 24 which support the bottles corresponds approximately to the bottom dimension of the rows of bottles B, when grouped as indicated in FIG. 1. The top wall forming panel section 18 and the adjoining sidewall forming panel sections 20 and 22 have an overall transverse dimension which is greater than the row dimension of the bottle assembly and these panels are subdivided, as hereinafter described, so as to provide along opposite sides of the blank hinged panel structures for closing the ends of the tubular carton which results when the blank 12 is folded and secured in bottle enclosing relation.

The bottom wall forming end panels 23 and 24 in the blank 12 have a dimension in the lengthwise direction of the blank sufficient to provide overlapping marginal portions when they are in carton forming position and cooperating interengaging locking elements are cut therein for securing the two panels in wall forming relation and to provide a tight wrap about the bottle assembly. The end panel 24 which is rectangular in form and which extends between the carton bottom corner forming score line 17 and the parallel end edge 33 of the blank 12 has a plurality of spaced, transversely aligned latch receiving apertures 34 cut therein, there being three in the illustrated form of the blank, which corresponds to the number of bottles in a row. The apertures or latch receiving openings 34, which may be termed the female locking elements, are each in the form of a truncated triangle. They are each defined by cutting lines, which may be as shown in U.S. Pat. No. 4,029,204 granted June 14, 1977, and in U.S. Pat. No. 3,670,950, granted June 20, 1972. Each latch opening or aperture 34 is defined by a generally U-shaped main cutting line 35 which opens inwardly of the panel 24 with short terminal leg portions 36 in diverging relation and with an inner connecting base line 37 extending transversely between the cutting lines 36 and spaced inwardly of the transversely extending base portion 38 of the U-shaped cutting line 35. The end panel section 23 at the opposite end of the blank 12 is divided by a transverse score line 40, which is parallel with the score line 14 and spaced therefrom, so as to provide a bottom wall forming portion 42 and a terminal latch bearing portion 43. The score line 40 is interrupted by a series of transversely spaced, relatively short cutting lines 44 which are generally C-shaped and extend into the panel 42, with the terminal ends thereof reversely curved, so as to form primary locking tabs 45. The tabs 45 are longitudinally aligned with female apertures 34 for engagement in the latter at the outermost edges 38 thereof. Secondary locking or latching tabs, or fingers 46, are provided, in longitudinal alignment with the locking tabs 45, which are spaced along the opposite free edge of the panel 42 and have a configuration which includes a neck portion 47 of reduced width corresponding, approximately, to the width of the apertures 34 at the innermost edge 37 thereof. The locking and latching tabs and cooperating apertures may be formed as shown in U.S. Pat. No. 4,029,204, granted June 14, 1977; U.S. Pat. No. 3,589,593, granted June 29, 1971; and in U.S. Pat. No. 3,432,029, granted Mar. 11, 1969.

The transverse score line 17 which defines the edge of the bottom wall forming panel 24 is interrupted by transversely spaced bottle movement restraining apertures 50, which are spaced according to the bottle spacing in the rows and which are longitudinally aligned in the blank with the locking and latching tabs 45 and 46. The innermost edge of each aperture 50 is defined by a curved cutting line 52 which is in the form of a segment of a circle and which is bowed in the direction of the end of the blank. These cutting lines interrupt a transverse score line 53 which is parallel with and spaced inwardly of the transverse score line 17 and which cooperates with the latter in forming a narrow bottom corner edge panel 54 in the final package. The apertures 50, in which bottom edge portions of the bottles seat, may be in the form shown in U.S. Pat. No. 4,029,204. At the other end of the blank 12 the bottom edge forming score line 14 is interrupted by transversely spaced bottle retaining apertures 56 which have inboard edges formed by outwardly bowed or curved cutting lines 57 which interrupt a transverse score line 58 spaced inwardly from, and parallel with, the score line 14 so as to form a narrow bottom edge panel 60. This arrangement is formed the same as the apertures 50 and panel 54 at the opposite end of the blank, and provides like bottle movement restraining means for the row of bottles on that side of the assembly.

The two panel forming sections 20 and 22 have formed therewith end wall closure forming panels of the type which are commonly referred to as "barn door" panels. Panel section 20 has a pair of generally rectangular carton end closing panels 62 and 63 formed along the sides of the blank, or the ends of the sidewall forming panel portions 27, 28, which are separated therefrom by hinge forming longitudinal score lines 64, 65 extending from the opposite ends of the transverse score line 58 to points 66, 67 at the opposite ends of the transverse score line 15. The score lines 64, 65 are generally parallel and extend to points of intersection with the transverse score line 25 with portions 68, 70 which extend from the score line 15 to the points 66, 67 being slanted inwardly of the blank 12 and defining, with the score lines 72 and 73, which slant outwardly of the blank, triangular glue panels 74 and 75, which are foldable and which connect the panels 62, 63 at their upper ends with the top or upper sidewall panel portion 27 in the set up carrier. The panels 62 and 63 are generally rectangular and have a dimension outboard of the score lines 64 and 65 which is somewhat greater than the diameter of the bottles so as to have the margins overlap when hinged to end closing position in the set up carton. The panels 62 and 63 extend longitudinally of the blank from points adjacent the score line 14 to the points 66 and 67. The top forming outboard corners of the panels 62 and 63 are notched at 76 and 77 and the bottom inboard corners are notched at 78 and 80 so as to provide free edges for engaging the inside faces of the marginal ends of the bottom edge panel 60 when the carton is formed. The panel section 22 has formed along the side margins of the blank rectangular end wall forming panels 82 and 83 which are separated from the sidewall forming panel 32 by longitudinally extending hinge forming score lines 84 and 85 which extend from the ends of the transverse score line 53 to the points 86 and 87 at opposite ends of transverse score line 16 and define the end edge of the upper sidewall panel portion 30. The portions 88 and 90 of the score lines 84 and 85 which extend from the ends of transverse score line 26 to the points 86 and 87 are inclined inwardly of the blank 12 and form with the outwardly inclined score lines 92 and 93 triangular glue panels 94 and 95 corresponding to the glue panels 74 and 75. The end wall forming panels 82 and 83 are dimensioned the same as the end wall forming panels 62 and 63 with corresponding corners notched at 96, 97 and 98, 100. The sidewall forming portions 27, 28 of the panel section 20 may be cut as indicated at 102 to provide a tear out feature of well known character so as to provide access to the bottles through a sidewall opening. The score line 25 may be extended into the end wall forming panels to facilitate interfolding of the end wall panels.

The center panel section 18 of the blank 12 is cut and scored to provide the rectangular top wall forming panel portion 103, which is defined by the longitudinal score lines 104, 105 and transverse score lines 106, 107, has formed at opposite sides of the blank top end wall forming panels 108 and 110 which are designed to be folded down so as to interlock with the main end wall forming panels 62, 82 and 63, 83 and securely hold the latter in end wall forming position when the carton ends are closed by the latter. The panel portions 108 and 110 are of identical configuration and only panel 108 will be described in detail, the panel 110 at the opposite side of the blank being scored in like manner so as to constitute a mirror image of panel 108. Score lines 112 and 113 extend from the intersection of score line 104 with the associated transverse score lines 106 and 107, indicated at 114 and 115, to the points 66 and 86 at the top forming ends of the score line portions 68 and 88, respectively. The panel 108 has outwardly opening V-shaped notches 116, 117 extending from apexes at 66 and 86 which free the outermost portion of the panel 108 from the top forming edges of the panels 62 annd 82. The score lines 112 and 113 define the end edges of narrow transverse panels 118 and 120 which extend between the transverse score lines 106, 15 and 107, 16. The panels 118 and 120 are cut in a well known manner to provide transversely spaced apertures 122 along the score line 106 and 123 along the score line 107 in which the outer edges of the bottle caps or mouth portions are received. The panels 118 and 120, which serve to prevent any movement of the tops of the bottles, constitute in effect top marginal portions of the sidewall panel portions 27 and 30, respectively. The end wall forming panel 108 is scored on the lines 124 and 125 which run from apex points 114 and 115 to the outer edge of the panel 108, at an angle to the lines 112 and 113, with which they define triangular web panels 126 and 127, the latter integrally connecting the panel 108 with corresponding ends of the panels 118 and 120. In addition the panel 108 is scored on the lines 128 and 130 which extend in converging relation from the apex points 114 and 115 to a small end panel locking tab or finger 132. The top wall panel 103 has cut therein a pair of spaced finger receiving holes 133 and at opposite ends an arrangement of tear slits 134 and 135 permitting tear outs for access to the bottles through the top panel.

In applying the blank 12 to an assembly of the bottles B the top wall forming panel 103 will be centered on the top surface of the bottle caps and the opposite ends of the blank folded down around the sides and bottom faces of the assembly with the bottom wall forming panels 24 and 42 tightly drawn toward each other while the overlapped margins are secured by engaging the latch elements 44 and 46 in the cooperating apertures 34. The barn door panels 62, 82 and 63, 83 at opposite ends of the tube thus formed are then folded into end wall forming position with the sidewall connecting webs 74, 94 and 75, 95 being folded inwardly so as to lie along the inside faces of the associated end wall panels. The end wall top panels 108 and 110 are then folded down and the locking tabs 132 and 136 are engaged in the upwardly opening slots formed by the cooperating notches 76, 96 and 77, 97 to retain the panels 62, 82 and 63, 83 in end closing position. The triangular web panels 126 and 127, and the corresponding web panels of 110, fold into overlying relation with the topmost portions of the triangular webs 74, 94 and 75, 95. Preferably, the web panels are secured to each other by a spot of glue as indicated on 74, 94 and 75, 95.

While certain of the score lines referred to are shown on FIG. 6 of the drawing as lines of small cuts or perforations it will be understood that these are fold lines which may be formed either by cuts or perforations or by creases depending upon the thickness of the material and the degree of bending desired for the particular fold.

I claim:

1. A carrier package comprising an assembly of articles, in the form of bottles, arranged in a double row and in transversely aligned pairs, enclosed in a tubular carton formed from a single blank of paperboard or similar foldable sheet material, said carton having a top wall panel, integrally hinged sidewall forming panels depending from side edges of said top wall panel and extending along the oppositely disposed outer side faces of the article assembly, bottom wall forming panels integrally hinged to the bottom edges of said sidewall panels and extending inwardly toward each other with overlapped margins, which margins of said bottom wall forming panels have interengaging cooperating means securing the panels together and forming a tightly wrapped package, end wall forming panels integrally hinged to the ends of said sidewall panels and disposed in end closing relation at opposite ends of the tubular carton, the uppermost portions of said end wall panels being slanted inwardly of the articles and being connected to the sidewall panels by inwardly folded triangular web formations which lie on the inner faces of upper portions of said sidewall panels, said end wall panels having inner marginal portions in overlapping relation, locking panels hinged to the opposite end edges of said top wall forming panel and folded downwardly therefrom into overlying relation with top marginal portions of said end wall panels, and latch means on said locking panels which are interengaged with cooperating means on the overlapping marginal portions of said end wall panels securing said panels in end closing position.

2. A carrier package as set forth in claim 1 wherein said cooperating latch means on said end wall panels and said locking panels comprises a slot formation in the overlapped portions of said end wall panels and a latch tab on the lower margin of the associated locking panel which engages in said slot formation.

3. A carrier package as set forth in claim 1 wherein said end wall panels each have a top portion integrally connected to an inwardly inclined top portion of the associated sidewall forming panel by a triangular web formation which is folded inwardly and secured along the inner face of the associated sidewall portion and the associated locking panel has a triangular web portion folded into engagement with said web formation.

4. A blank of paperboard, or other foldable sheet material of similar character which is adapted for wrapping about a group of articles having the form of bottles arranged in double row transversely paired relation so as to form a bottle enclosing tube, which blank is generally rectangular and divided into a series of wall panel forming sections, by longitudinally spaced, parallel, hinge forming score lines, said wall panel forming sections comprising a top wall panel forming center section, adjoining sidewall and end wall panel forming sections and bottom wall panel forming sections at opposite ends of the blank, said bottom wall panel forming sections having a combined dimension in the lengthwise direction of the blank which is greater than the transverse dimension of the group of articles so as to enable the free end margins thereof to be overlapped and secured together when the blank is folded into tubular carton forming relation and tightly drawn about the group of articles, said bottom wall forming panel sections having a dimension in the direction transversely of the blank which is slightly greater than the combined dimension of the articles in a row, said center panel section and said adjoining sidewall and end wall panel forming sections having a dimension transversely of the blank which exceeds the combined dimension of the articles in a row, said sidewall and end wall panel forming sections each being subdivided by transversely spaced longitudinally extending hinge forming score lines into a sidewall forming panel and end wall forming panels which end wall forming panels are disposed along opposite side margins of the blank, said end wall forming panels having latching notches formed in the outermost corners adjacent said center section and said end wall forming panels having a dimension in the direction transversely of the blank which enables the outermost marginal portions to be overlapped when the carton is formed with the end wall panels at each end hinged to cooperating end closing relation, said end wall forming panels being scored on outwardly slanted lines adjacent the end of the hinge score line adjacent said center section of the blank so as to form triangular web portions, said center section of the blank being subdivided by hinge forming score lines into a rectangular top wall forming panel and end wall locking panels at opposite ends thereof, which locking panels extend along opposite sides of the blank and outboard of the ends of the top wall forming panel, said locking panels being scored on lines extending diagonally outwardly of the intersection of said subdividing score lines with the score lines separating the top wall panel and the sidewall panels so as to provide triangular web formations therein adjacent the corners of the center section, said locking panels each having at the outer margin a locking tab for interlocking engagement with said latching notches in the end wall forming panels when the blank is formed into a tubular carton and the end wall panels are hinged to end closing position with the margins overlapped.

* * * * *